US009165481B2

(12) United States Patent
Brauner et al.

(10) Patent No.: US 9,165,481 B2
(45) Date of Patent: Oct. 20, 2015

(54) LABELING DEVICE FOR MARKING A CONTAINER FOR DRINKING LIQUIDS

(75) Inventors: Oliver Brauner, Gelsenkirchen (DE); Ulrich Poesselt, Gelsenkirchen (DE)

(73) Assignee: Ulrich Poesselt, Gelsenkirchen (DE)

( * ) Notice: Subject to any disclaimer, the term of this patent is extended or adjusted under 35 U.S.C. 154(b) by 0 days.

(21) Appl. No.: 14/232,669

(22) PCT Filed: Jul. 16, 2012

(86) PCT No.: PCT/EP2012/063869

§ 371 (c)(1),
(2), (4) Date: Feb. 19, 2014

(87) PCT Pub. No.: WO2013/010972

PCT Pub. Date: Jan. 24, 2013

(65) Prior Publication Data

US 2014/0165433 A1 Jun. 19, 2014

(30) Foreign Application Priority Data

Jul. 15, 2011 (DE) ..... 10 2011 051 887

(51) Int. Cl.
*G09F 3/00* (2006.01)
*G09F 3/06* (2006.01)
*B65D 23/14* (2006.01)

(52) U.S. Cl.
CPC . *G09F 3/06* (2013.01); *B65D 23/14* (2013.01)

(58) Field of Classification Search
CPC ..... B65D 15/245; B65D 23/14
USPC ..... 40/310, 311
See application file for complete search history.

(56) References Cited

U.S. PATENT DOCUMENTS

| | | | | |
|---|---|---|---|---|
| 758,235 | A | 4/1904 | Cady | |
| 2,957,596 | A | 10/1960 | Rehborg | |
| 2,976,629 | A | 3/1961 | Brixius et al. | |
| 2004/0068900 | A1 * | 4/2004 | Moran | 40/311 |
| 2008/0093325 | A1 | 4/2008 | Costello | |
| 2010/0000960 | A1 * | 1/2010 | Anderson | 215/228 |
| 2010/0170910 | A1 | 7/2010 | Ludewigs et al. | |

FOREIGN PATENT DOCUMENTS

| | | | |
|---|---|---|---|
| DE | 87 10 651 | U1 | 10/1987 |
| DE | 296 05 398 | U1 | 7/1997 |
| DE | 20 2006 006 206 | U1 | 8/2006 |
| DE | 20 2009 000 138 | U1 | 3/2009 |

(Continued)

OTHER PUBLICATIONS

International Search Report of PCT/EP2012/063869, mailed Oct. 11, 2012.

*Primary Examiner* — Joanne Silbermann
(74) *Attorney, Agent, or Firm* — Collard & Roe, P.C.

(57) ABSTRACT

The invention relates to a labeling device, comprising a modular base carrier (2) designed to be arranged on the container (15) and an attachment element (9) for individually marking a container (15) for drinking liquids, which attachment element has a fastening device (9*b*). The attachment element (9) is designed as a closure for a container opening (17) of the container (15), and the fastening device (9*b*) is designed in such a way that the attachment element (9) can be detachably connected in a form-closed and/or force-closed manner to the container (15) in a first position and to the base carrier (2) in a second position.

14 Claims, 3 Drawing Sheets

(56) References Cited

FOREIGN PATENT DOCUMENTS

Figure 1:
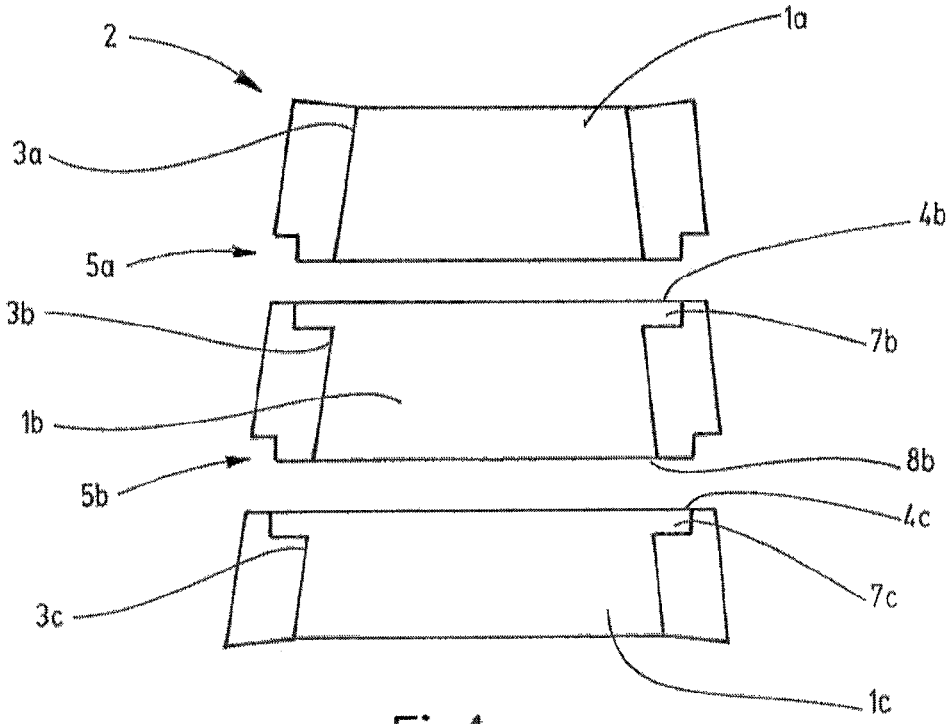

| | | | |
|---|---|---|---|
| DE | 20 2009 015 614 | U1 | 2/2010 |
| DE | 10 2009 037 908 | A1 | 2/2011 |
| EP | 0 865 015 | A1 | 9/1998 |
| JP | 2004-175447 | A | 6/2004 |
| JP | 2006-082875 | A | 3/2006 |
| WO | 00/63087 | A1 | 10/2000 |

* cited by examiner

LABELING DEVICE FOR MARKING A CONTAINER FOR DRINKING LIQUIDS

CROSS REFERENCE TO RELATED APPLICATIONS

This application is a National Stage of PCT/EP2012/063869 filed on Jul. 16,2012 which claims priority under 35 U.S.C. §119 of German Application No. 10 2011 051 887.8 filed on Jul. 15, 2011, the disclosure of which is incorporated by reference. The International application under PCT article 21(2) was not Published in English.

The invention relates to a marking device for tagging a container for beverages, having a base carrier configured to be disposed on the container, and having a cap element having an attachment device.

At social or convivial events, containers that are all of the same kind and contain beverages are frequently served. This results in a high risk of confusion of the containers, which represents a hygiene risk for the users. Furthermore, there is an increased risk at such events that foreign substances, such as food residues (crumbs) or, for example, even cigarette butts enter into the beverage container or that beverage containers tip over and run out.

From the documents DE 10 2009 037 908 A1, DE 20 2009 015 614, and U.S. Pat. No. 2,976,629, marking devices for beverage containers are known, which are attached to a container and individualize the container by means of their different shape, color, or configuration. Furthermore, information carriers connected with these marking devices are proposed, which can be individualized by means of labeling applied by the user of the container, using a pen.

From DE 20 2006 006 206 U1, a marking device is known that is composed of multiple elements, in which individualization of the container takes place by means of bringing together different elements.

However, none of the marking devices known from the state of the art go beyond the function of marking the container.

In contrast, the task of the invention consists in improving such a marking device in such a manner that it is not only suitable for individual tagging of a container for beverages, but beyond that can fulfill further functions.

This task is accomplished with a marking device having the characteristics of claim 1. Advantageous further developments of the invention are indicated in the dependent claims.

The marking device according to the invention, for tagging a container for beverages, has at least one base carrier configured to be disposed on the container, and a cap element configured as a closure for a container opening, having an attachment device, whereby the attachment device is configured in such a manner that the cap element can be releasably connected with the container in a first position, and with the base carrier in a second position, with shape fit and/or force fit.

The marking device according to the invention not only makes a great number of possibilities for individual tagging of the container possible for the user, but in addition, makes double positioning of the cap element on the container and on the base carrier possible. In this way, the user is enabled, in advantageous manner, to seal the container, to easily recognize his/her container, and to handle the marking device in simple and practical manner, which is not disruptive when using the container.

In its function as a closure, different embodiments of the cap element are possible. For example, the cap element can be configured in such a manner that it only covers the container opening and prevents foreign bodies from falling into the container. Also, embodiments are possible in which the cap element engages into the container opening, for example, so that the beverage is prevented from exiting from the container and/or gas (carbonation) present in the beverage is prevented from exiting from the container.

The cap element, configured as a closure, can furthermore be configured as a tag or a tag carrier. Thus, it is possible, for example, that the shape of the cap element is adapted to a known shape (e.g. animal shape). However, geometrical shapes, such as polygonal, round, oval shapes or shapes that can be combined from them are also possible. Preferably, the cap element has at least one planar top that can be written on, can have labels adhered to it, or is structured in some other manner, for example.

Also, the cap element can additionally be configured as a handle, ring, or the like, thereby making particularly simple and practical handling, carrying, or conveying of the container by way of the cap element possible.

The attachment device is configured to allow not only attachment of the cap element to the base carrier but also attachment of the cap element on the container. In this regard, the configuration of the connection can range from simple fixation, in which the cap element can still be moved relative to the base carrier/container by way of multiple axes of movement, to positioning in which the cap element can still be moved by way of one or two axes of movement relative to the base carrier/container, all the way to a firm connection, in which a relative movement of the cap element is no longer possible.

The connection between the cap element and the base carrier and/or the connection between the cap element and the container, configured by the attachment device, can be achieved by force fit and/or shape fit, and is releasable. In this connection, releasable is understood to mean that the connection, in each instance, can be released without destruction and restored. It is thereby reversible and therefore allows particularly simple and practical handling of the marking device, in advantageous manner.

In the sense of the invention, force fit is understood to mean all connections in which a normal force acts on the surfaces to be connected. This includes, for example, all connections that are brought about by way of friction, suction, magnetic or molecular forces (for example adhesion forces). A shape-fit connection is understood to be a connection in which a relative movement between the components to be connected is prevented, at least in part, by means of engagement of the components into one another. This includes, for example, snap, click, clamp, screw or hook connections.

The first position is understood to be a closure position in which the cap element or the attachment device on the cap element is in direct contact with the container and closes off its outlet opening. As has already been explained, fixation, positioning, or a firm connection can be understood to be a closure in this sense.

In the second position, also referred to as tagging position hereinafter, the cap element or the attachment device (cap element) is in direct contact with the base carrier. This position allows the user of the container to drink from the open container in advantageous manner, without being hindered by the cap element—for example by holding the cap element in his/her hand while drinking. Accidental loss of the cap element is also prevented by means of the releasable connectability of the cap element with the base carrier in the second position. It is advantageous if the connection between the cap element and the base carrier is configured in such a manner that in this second position, particularly good visibility of the cap element is made possible, particularly when containers are set down on tables or windowsills.

The marking device according to the invention is particularly suitable for containers in bottle form, glasses, mugs, or pitcher forms. In particular, bottles that are structured to be uniform in their shape, such as beer bottles or soda bottles, are suitable for use of the marking device according to the invention.

The base carrier has two functions. For one thing, it serves as the carrier for the cap element. For this purpose, it is configured in such a manner that the cap element can be connected with it or disconnected from it in particularly simple and quickly releasable manner. For another thing, it must be possible to place the base carrier on the container. In this connection, placement is understood to mean attachment, fixation or positioning on the container. Placement can take place by way of a shape-fit and/or force-fit connection.

It can be possible to place the base carrier on an outer side, an outer edge or outer surface of the container. Accordingly, the base carrier can be configured to be clipped onto or put over the container. Also, forms for firmly clamping the base carrier onto the container, or flexible forms for tying it on or fixing it in place with a hook and loop closure are possible. Preferably, however, the base carrier is adapted to a basic shape of the container to be tagged.

Placement of the base carrier on the container can take place at the most varied positions of the container. In the case of a bottle as the container, the base carrier can be configured in such a manner, for example, that it is put over the neck of the bottle or is configured as a clip and clipped onto the neck of the bottle. Also, it is possible to configure the base carrier in such a manner that it is placed on the actual body of the bottle. Connections of the base body with the container by way of releasable glue, hook-and-loop, clamp or adhesive connections are also possible. For this purpose, corresponding additional connection means can also be used.

The attachment device on the cap element generally has different attachment device elements. For example, the attachment device can be configured as a magnetic or plug/clamp connection. The plug/clamp can be structured, for example, as a ring-shaped attachment device element or as a multi-part ring segment. Combinations of different types of connections are also possible. For example, an attachment device can have elements configured magnetically, for connecting the cap element with the base carrier, and elements for a plug-in connection between the cap element and the container.

According to an advantageous further development of the invention, the attachment device has at least two clamping arms that are configured in such a manner that they clamp the cap element in place on the container in the first position and/or on the base carrier in the second position. Different shapes and arrangements are possible for the clamping arms. It is possible, for example, to configure the clamping arms in such a manner that they are clamped in place by the base carrier and/or by the container opening. Preferably, however, the clamping arms are disposed in such a manner that they can be pushed over the base carrier and, if applicable, also over the container, and thereby clamp the base carrier and/or the container in place between the clamping arms. A combination is also possible.

It is advantageous if the clamping arms are positioned on the cap element in a position disposed to lie opposite, so that not only the base element but also the container, at the container opening, is clamped in between the clamping arms. For this purpose, the clamping arms can be configured to be resilient, i.e. easily bendable.

Preferably, the attachment device has clamping arms and a plug-in device for insertion into the container opening. In this connection, the clamping arms are configured not only for additionally clamping the container in at the container opening but also for clamping in the base carrier. The plug-in device can exert clamping forces that act radially outward, for example, on the inside wall of the container in the region of the container opening, while the clamping arms exert clamping forces that act radially inward on the outside wall of the container in the region of the container opening and/or additionally absorb axial forces.

The combined attachment from a plug-in device and clamping arms allows a particularly firm connection between the container and the cap element in the first position, thereby making it possible, for example, to prevent escape of carbonation from the carbonated liquid in the container, or also to carry the filled container by the cap element.

In a particularly preferred embodiment, the attachment device has at least two pairs of clamping arms, i.e. at least four clamping arms are provided, whereby two clamping arms lie opposite one another, in each instance, and are configured in such a manner that they clamp the cap element in place on the container in the first position and clamp the cap element in place on the base carrier in the second position, and position it relative to the latter. In this sense, positioning is understood to be an additional restriction of the relative movement between cap element and base carrier that is possible after it is clamped in place.

Preferably, the clamping arms are oriented in such a manner that one pair of clamping arms clamps the cap element in place on the base carrier. The second pair of clamping arms can be configured, for example, for forming a defined distance of the cap element from the base carrier. For positioning of the cap element on the handle, two pairs of clamping arms are configured in such a manner that they engage over the rim of the container and the container is clamped in place between the clamping arms. In this way, an advantageous, particularly stable connection is formed between the cap element and the container. This connection is also suitable for preventing escape of carbonation or for carrying the device by the cap element.

According to a further development of the invention, the marking device is characterized by a snap element configured on the clamping arms, for snapping the clamping arms in place on the container and/or on the base carrier. A snap element can be understood to be a simple notch, called a support notch, by way of which simple snapping of the clamping arm onto the base carrier and/or container is made possible. Also, the snap element can have a plurality of individual notches, so that different snap-on positions of the cap element on the container and/or on the base carrier are possible. In this way, it is possible, for example, to change the degree of attachment, i.e. the amount of the force with which the cap element is attached to the container and/or the base carrier. For example, an embodiment is also possible in which the cap element is connected with the base carrier by way of the clamping arms, with a single snap connection, whereby the connection of the cap element on the container, however, is particularly firm, by way of a multiple snap connection.

According to a further development of the invention, the clamping arms are disposed on a common circular path. The clamping arms are thereby disposed coaxially about a center point, and all have the same distance from the center point. It is advantageous if they additionally face out from a plane of the cap element or are configured as clamping arms that lie on the inside, i.e. as cavities or indentations in the cap element. The clamping arms can be configured, for example, in rod shape or plate shape. Also, they can assume bent shapes that are adapted to the circular path. Furthermore, the clamping arms can also be shaped to be bent in a direction that faces away from the plane of the cap element.

Particularly preferably, the cap element and the attachment device are configured in one piece. A cap element with attachment device that is configured in one piece can be produced as a cast or injection-molded body, for example. However, in one piece in the sense of the invention also comprises bodies connected with one another, which cannot be released from one another, i.e. cannot be separated without destroying them. Therefore bodies that are glued to one another or welded to one another, which form an attachment device with cap element, should be considered as being in one piece.

In this connection, combinations of the same or different materials are also possible. Thus, the cap element and the attachment device can consist of the same materials, or of different materials, in each instance. Preferably, both the attachment device and the cap element consist of plastic, metal, wood or a material that contains wood, or any desired material combination of these.

According to a further development of the invention, the cap element has a sealing element for sealing the container opening. It is advantageous if the sealing element is disposed on the cap element in such a manner that it lies against a rim, a surface, or an edge of the container opening in the first position, or engages into the container opening, so that secure sealing of the container opening is made possible.

In this connection, the sealing element preferably has an elevated, ring-shaped sealing lip for direct contact against the container opening. This elevation in O-ring shape of approximately 0.1 to 0.3 mm ends precisely with the opening rim of the glass bottle when pressed. In this connection, it is furthermore preferably provided that the sealing element is releasably connected with the cap element by means of a clip. In this way, installation of the sealing element on the cap element is simplified, and furthermore, subsequent replacement of the sealing element is also fundamentally possible.

The sealing element can also be configured in one piece with the cap element. Thus, it is possible to bond a plastic lip onto the cap element as a sealing element, whereby preferably, the plastic lip consists of a more elastic material as compared with the cap element and/or the attachment device.

Preferably, however, the sealing element is configured as a separate component. It can be glued onto or braced against the cap element, for example, but preferably can be clamped in place, particularly between at least two clamping arms. Also, additional clamping elements, such as elevations or indentations that are disposed coaxially or centered, can be formed on the cap element.

The shape of the sealing element is preferably adapted to the container opening. In particular, the sealing element is configured in circular shape, disk shape, ring shape and/or planar shape.

Preferably, a softer or more elastic plastic or rubber material, as compared with the cap element, which is suitable for use in the foods sector, is used. In particular, foams, for example polyurethane foams, or vulcanized rubber materials are used.

An embodiment in which a circular sealing ring made of rubber is disposed around a centered, round (circular or disk-shaped) clamping element is preferred. The clamping element has a circumferential indentation, into which the rubber ring is laid or in which it is braced. Fixation of the rubber ring takes place by means of the indentation. Also, additional fixation of the rubber ring, if necessary, can take place by means of a lesser inside diameter of the rubber ring as compared with the indentation or as compared with the round clamping element. In this embodiment, the cap element is attached, in the first position, by means of the rubber ring that engages into the container opening. In this connection, the rubber ring with clamping element can have a slightly greater outside diameter as compared with the inside diameter of the container opening. The rubber ring, positioned in the container opening, generates the clamping forces that act radially outward, as has already been mentioned. Alternatively, clamping arms or the like can be additionally configured.

In an alternative advantageous embodiment, a planar, for example disk-shaped sealing element, composed of an open-cell or closed-cell foam, for example, is clamped in place between at least two clamping elements (for example between two clamping arms), and lies on a rim of the container opening in the first position.

According to a further development of the invention, the base carrier is configured in ring shape or in ring segment shape. When using the marking device for bottles as a container, a ring-shaped or ring-segment-shaped configuration is advantageous, because such a base carrier can be put over the neck of the bottle particularly easily and lies against the body of the bottle particularly tightly, thereby avoiding unnecessary projection of the base carrier from the container.

Necks of bottles, in particular, have a conical configuration, i.e. they narrow toward the opening of the bottle. In order to allow particularly good adaptation of the base carrier to the container, particularly to a bottle, the base carrier has a conically configured inside surface, at least in certain sections. A conically configured inside surface on the base carrier can be placed, particularly advantageously, on a body of a bottle, particularly on a conically configured neck of a bottle. It stands in direct contact with the body of the bottle over a particularly large area, and allows the formation of a base body having a particularly slight projection beyond the actual body of the bottle. Furthermore, a slight clamping effect of the base carrier is produced by means of a conically configured inside surface, when the carrier is put over a conically configured neck of a bottle, so that particularly advantageous fixation, if necessary also positioning of the base carrier on the neck of the bottle is achieved.

In addition to the functions as a carrier of the cap element on the connection means with the container, the base carrier can also be configured as a tagging element. For this purpose, surface sections that can be individualized in particularly simple manner can be disposed on the base carrier. Also, it is possible, for example, to use base carriers that are tagged differently, in order to achieve individualization, in each instance. Thus, the visible outside of the base carrier can be marked with special shapes, textures, or colors, for example.

Particularly preferably, however, the base carrier is formed from a plurality of base elements, whereby a first base element has at least one surface section that is configured to correspond to at least one surface section of a second base element. Corresponding, in this connection, is understood to mean surface sections that are coordinated with one another and form a positive/negative shape (profile), for example. The corresponding surface sections allow a connection between the base elements. This connection can take place, as has been explained, as fixation, positioning or as a firm bond.

The formation of the corresponding surfaces can have the most varied shapes. Thus, they can be round (for example dome-shaped) recesses and corresponding hollow recesses. However, they can also be planar surfaces that are meshed with one another by way of a specific structure or arrangement.

According to a further development of the invention, the corresponding surfaces are configured in such a manner that they can be screwed or clamped against one another, snapped into one another and/or hooked into one another. By means of such a configuration, a particularly secure and adapted connection between the base elements is possible. Furthermore, re-usability of the base elements is possible. The corresponding surface sections, which are connected with one another, are configured reversibly in each case, i.e. the connection produced by way of the corresponding surfaces can be released.

Particularly preferably, the corresponding surface sections are configured as a tongue-and-groove connection or as a lap. In this connection, the base element has a groove that is configured corresponding to a tongue on a second base element. A stable connection of the two base elements with one another is possible by means of inserting the tongue and groove into one another. A lap is understood to be engagement of surface sections over one another. Laps are particularly known from the sector of wood connections. Both types of connections can be produced in particularly simple and cost-advantageous manner, and have particularly great stability with regard to damage.

According to a further development of the invention, the first base element can be distinguished from the second base element in terms of color, by means of its type of material and/or by means of its physical shape. In this connection, each base element can be configured to have one color or multiple colors. The physical shape of the individual base elements can also be different. Thus, one base element can be configured to be round in its basic shape, with a flat surface, for example, while a second base element is configured to be round in its basic shape, but with a domed outer surface. Here, all polygonal, round or oval embodiments and combinations are possible.

Even in the case of differently configured physical shapes, the base elements can be connected with one another by way of the corresponding surfaces. By means of these different configurations in the physical shape or in the colors, particularly simple ability to individualize the base carrier is possible, thereby making it possible to individually mark containers for drinking.

Furthermore, it is preferably provided that at least one base element has a further ring-shaped, circumferential rubber lip that can be firmly laid against a neck of a bottle, with a clamping effect. By means of this rubber lip, which is preferably soft, an even better clamping effect of the at least one base element on the neck of the bottle is guaranteed.

Furthermore, in a further preferred embodiment, it is provided that the cap element can be radially attached to the base carrier, by means of the attachment device, in such a manner that the base carrier and the cap element together form a handling and carrying device for the container. This can be achieved, for example, with an elevation or a depression on the clamping arms of the attachment device. In the attached position, the base carrier is therefore connected with the cap element in the upper region of the neck of the bottle, so that a relative movement between the cap element and the base carrier is not possible, and the marking device as a whole forms a carrying aid for the bottle closed using the marking device. This position is thereby a third possible position of the device.

Furthermore, the task underlying the invention is accomplished by means of a cap element for a marking device as described above, having an attachment device for attaching the cap element to a base carrier, whereby the cap element is configured as a closure for a container opening, and the attachment device has at least two clamping arms that are configured in such a manner that they clamp the cap element in place on the container in a first position and/or on the base carrier in a second position.

The inventive cap element is configured as a closure for a container opening, particularly for an opening of a standardized bottle, such as a beer bottle or a soda bottle. For this purpose, it can be connected to the container in a first position, the closure position, by means of the attachment device. In addition, it can be attached to a base carrier that can also be connected with the container.

Aside from the closure function, the cap element can also take on a tagging function. The base carrier can also take on a tagging function in addition to its function as a connection means between cap element and container. For this purpose, not only the base carrier but also the cap element can be configured to be individualizable. For this purpose, different colors, shapes, tags or surfaces for tagging can be provided, in each instance.

Preferably, the cap element, the base carrier, and the attachment device on the cap element are coordinated with one another in such a manner that the cap element can be attached to the base carrier and, if applicable, also to the container in a position where it is particularly easily visible for the user of the beverage container.

Furthermore, the task underlying the invention is accomplished by means of a marking device kit for tagging at least two containers for beverages and having at least two cap elements configured as a closure for a container opening, in each instance, which each have at least one attachment device, whereby the attachment device is selected in such a manner that a cap element can be connected with a container in a first position and with a base carrier in a second position, and whereby the two base carriers, in each instance, and/or the two cap elements, in each instance, are configured in such a manner that they can be distinguished from one another in terms of color and/or by means of their physical shape.

The kit allows individualization and tagging of containers in particularly advantageous manner. Because of the plurality of configuration possibilities and the related great number of different combinations of the individual components of the kit, the ability to mark uniform bottles, for example, by means of the kit according to the invention, is possible in particularly simple manner.

A kit can contain base carriers that can be distinguished from one another in terms of their type of material, color and/or shape. In addition, it can contain cap elements that can be distinguished from one another in terms of the type of material, color and/or shape. In this way, a varied combination possibility already exists for a kit in the simplest embodiment. If the number of base carriers and/or cap elements is increased, the possible combinations multiply accordingly.

The kit therefore requires a particularly small total product line of distinguishable components, because of the great number of combination possibilities and possible configurations, thereby making it possible to produce the marking kit according to the invention in particularly cost-advantageous manner.

In this connection, it is particularly advantageous if the base carrier is configured from base elements, because the combination possibilities clearly increase further by way of the individual components.

The invention will be explained below as an example, using the drawing. This shows, in FIG. 1 a schematic cross-section, in an exploded representation, of an embodiment of a three-part base carrier, FIG. 2 a schematic representation of the three-part base carrier according to FIG. 1, with an embodiment of a cap element in the second position, FIG. 3 a schematic representation of an embodiment of the marking device according to the invention, with a container, FIG. 4 a top view of a sealing element without cap element, FIG. 5 a top view of the sealing element according to FIG. 4, with a clip for attachment to the cap element, FIG. 6 a view from below of a cap element adapted to the sealing element according to FIGS. 4 and 5, FIG. 7 a top view of a lid ring to be attached to the cap element according to FIG. 6, FIG. 8 a base element having a ring-shaped, circumferential rubber lip, and in FIG. 9 a schematic side view of the connected base carrier and cap element in the carrying position of the device.

FIG. 1 shows a base carrier 2 consisting of a first, a second, and a third base element 1*a*, 1*b*, 1*c*. The base elements 1*a*, 1*b*, 1*c* are configured to be ring-shaped in cross-section (horizontally) and have inside walls 3*a*, 3*b*, 3*c* that are directed conically, and outside walls 3*d*, 3*e*, 3*f* parallel to these, also directed conically.

The second base element 3*b* has a recess 7*b* on a top side 4*b*, which recess is configured to correspond to a circumferential elevation 5*a* on an underside 8*a* of the first base element 1*a*. The recess 7*b* and the elevation 5*a* that corresponds to it are configured, in terms of their shape, as surfaces that correspond to one another, here in the form of a lap. Because of the ring shape of the base elements 1*a*, 1*b*, the recess 7*b* and the elevation 5*a* clamp into one another when they are put together, and releasably connect the first base element 1*a* with the second base element 1*b*.

The third base element 1*c*, like the second base element 1*b*, also has a corresponding recess 7*c* on a top side 4*c*, which is configured to correspond to a circumferential elevation 5*b* on an underside 8*b* of the second base element 1*b*.

The base elements 1*a*, 1*b*, 1*c* consist of plastic and are produced using the injection-molding process. As a result, great shape precision of the base elements 1*a*, 1*b*, 1*c*, in each instance, is guaranteed even when producing large series, thereby making it possible to connect base elements with one another even if they are from different series.

Alternatively to the three-part configuration shown, the base carrier 2 can also be formed in one piece, from two base elements, or from a plurality of base elements.

Figure 2:
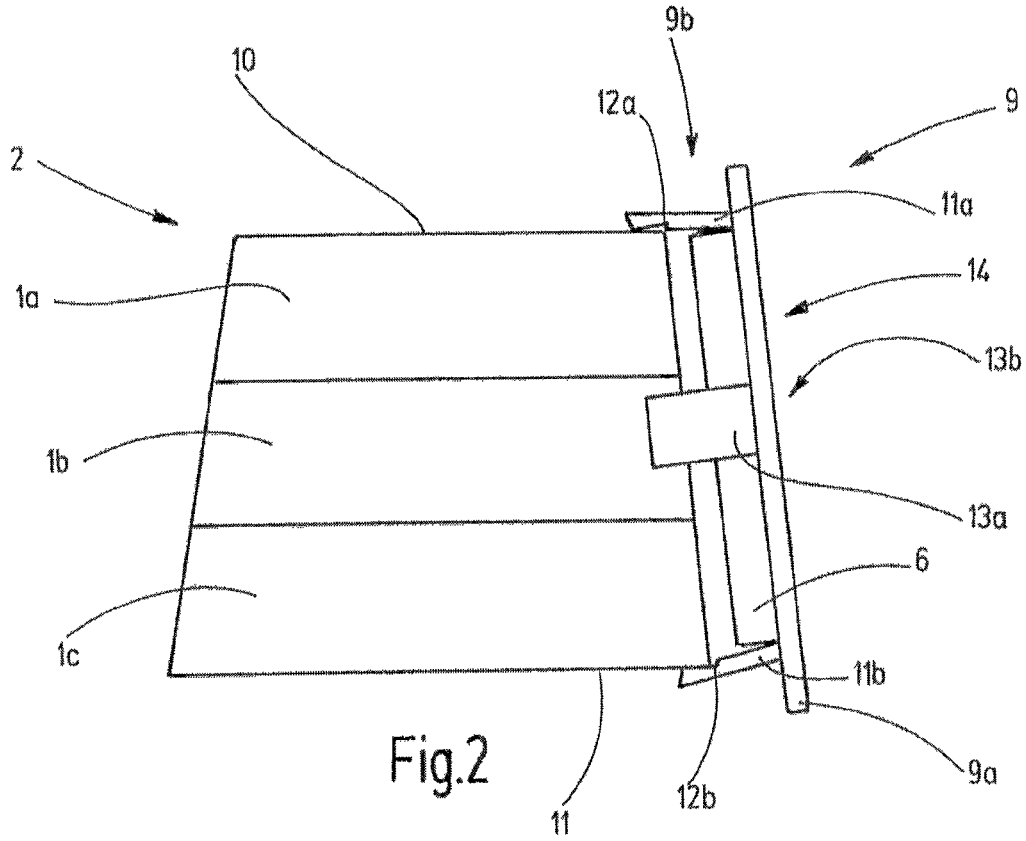

FIG. 2 shows the base carrier from FIG. 1. The base elements 1*a*, 1*b*, 1*c* are set onto one another and connected with one another by way of the underside elevations 5*a*, 5*b*, and top-side recesses 7*b*, 7*c*, in each instance.

Furthermore, a cap element 9 is shown, which is clamped onto the base carrier 2. The cap element 9 consists of base body 9*a* configured in planar manner, and an attachment device 9*b* disposed opposite a planar plane 14. The attachment device 9*b* has two pairs of clamping arms 11*a*, 11*b*, 13*a*, 13*b*, whereby two clamping arms 11*a*, 11*b* and 13*a*, 13*b*, respectively, stand opposite one another, in each instance. The clamping arms 11*a*, 11*b*, 13*a*, 13*b* are disposed on a circular path about a central point on the cap element 9. The clamping arms 11*a*, 11*b*, 13*a*, 13*b* are produced in one piece with the cap element 9, from a uniform material, for example plastic, using the injection-molding method. The plastic for the clamping arms 11*a*, 11*b*, 13*a*, 13*b* and the cap element 9 is produced from a more elastic plastic as compared with the plastic of the base carrier 2.

A further alternative embodiment of the cap element 9 has a base body that projects out of a back of the basic body 9*a*, for example a base ring, from which the clamping arms and/or further clamping elements project.

The cap element 9 is set onto an upper edge 10 and a lower edge 11 of the base carrier 2 by way of a first pair of clamping arms 11, 11*b* that stand opposite one another. Because of the shape and the placement of the clamping arms on the basic body 9*a*, these are easily bendable and allow simple connection and release of the cap element 9 with the base carrier 2 and the container 15.

All the clamping arms 11*a*, 11*b*, 13*a*, 13*b* have a support notch 12*a*, 12*b*, in each instance. The cap element 9 is hooked into the base carrier 2 by way of the support notches 12*a*, 12*b* of the first pair of clamping arms 11*a*, 11*b*. The second pair of clamping arms 13*a*, 13*b* positions the cap element 9 relative to the base carrier 2.

A disk-shaped sealing element 6 is disposed on a back of the basic body 9*a* that lies opposite the planar plane 14. This element is clamped in place and held by the clamping arms 11*a*, 11*b*, 13*a*, 13*b*. Alternatively to this, sealing element holders (not shown) can also be provided, which connect the sealing element 6 with the basic body 9*a*. These holders can be configured, for example, as additional centered and/or coaxially disposed elevations, or also as means for gluing the sealing element 6 to the basic body 9*a*.

The sealing element 6 consists of a plastic foam that is elastic and has good recovery forces, thereby allowing permanent re-usability as a sealing element 6. Furthermore, the foam made of plastic can be cleaned particularly easily.

The planar plane 14 has a paper carrier (not shown) that can be written on with a pen glued onto it. Alternatively, the planar plane 14 can be configured so that it can be written on directly, for example, or written on repeatedly, or is provided with an individual imprint/sticker or an advertising imprint/sticker.

Figure 3:
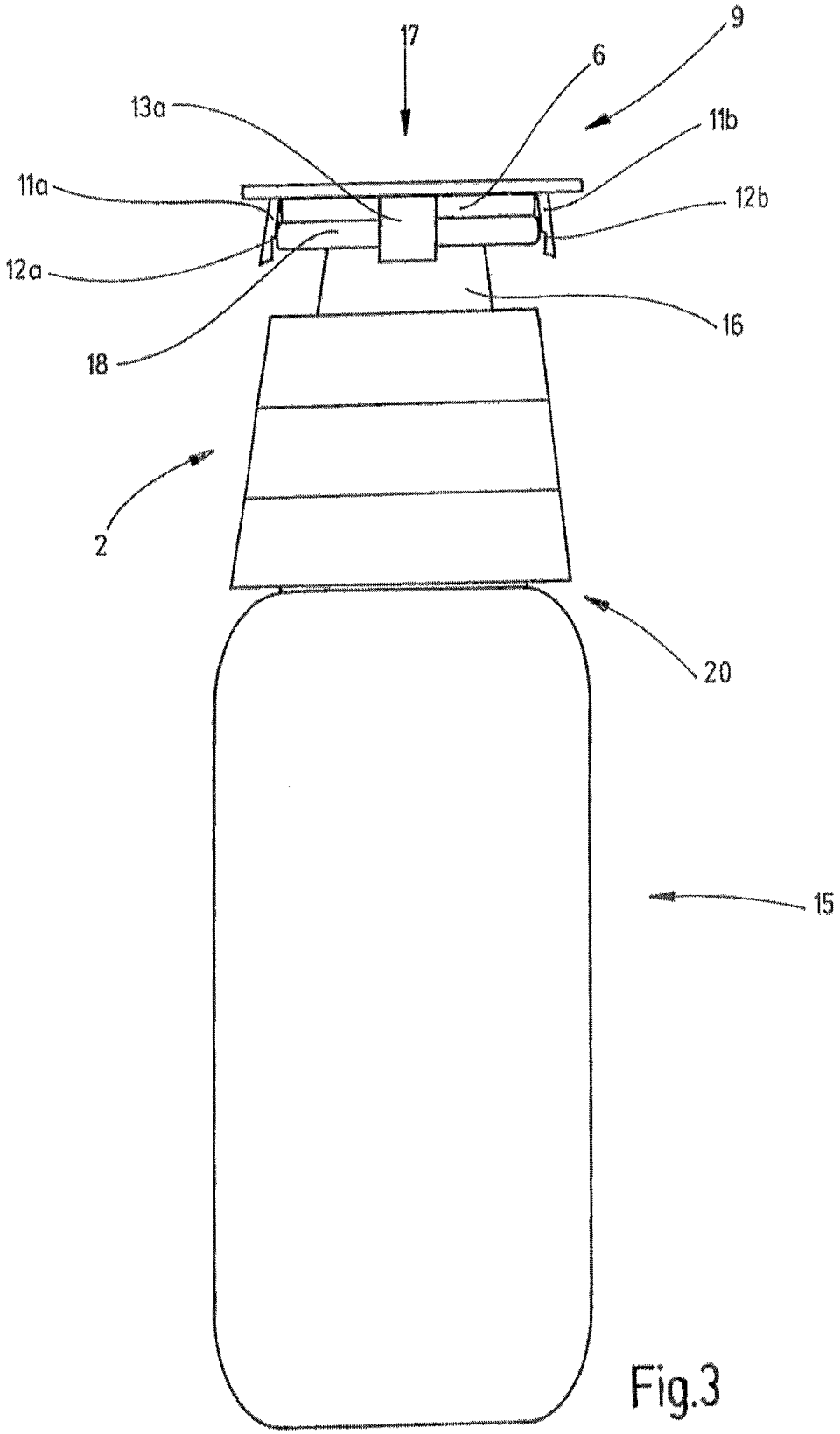

FIG. 3 shows a beverage bottle 15, over the neck 16 of which the base carrier 2 has been set. Because of the conical configuration of the neck 16 of the bottle and the conical configuration of the inside wall that is adapted to it, the base carrier 2 is slightly wedged against the neck 16 of the bottle. The base carrier 2 is thereby securely positioned on the neck 16 of the bottle. The projection 20 of the base carrier 2 beyond the neck 16 of the bottle is minimal and therefore causes particularly little annoyance for the user of the bottle 15.

Furthermore, FIG. 3 now shows the cap element 9 no longer connected with the base carrier 2, but rather disposed above a container opening 17 of the bottle 15. The clamping arms 11*a*, 11*b*, 13*a*, 13*b* of the attachment device 9*b* are set over an outer rim 18 of the bottle 15, in this connection. The support notches 12*a*, 12*b* of the clamping arms 11*a*, 11*b*, 13*a*, 13*b* are hooked onto the rim 18. The connection of the cap element 9 with the bottle 15 takes place by way of hooking of the support notches 12*a*, 12*b* in connection with a clamping pressure by means of the clamping arms 11*a*, 11*b*, 13*a*, 13*b*, onto the rim 18 of the bottle 15.

In order to achieve a particularly firm connection between the cap element 9 and the bottle, and between the cap element 9 and the base carrier 2, the height of the base carrier 2, i.e. the region to be clamped in between the clamping arms 11*a*, 11*b*, should be adapted to the outside diameter of the rim 18.

The sealing element 6 lies on the rim 18 of the bottle 15 in slightly compressed form, and prevents the carbonation of a carbonated beverage contained in the bottle 15 from escaping.

During use, the user of the bottle 15 can easily change the position of the cap element 9. By means of pulling slightly on the cap element 9, it can be released from the base carrier 2 or, accordingly, from the bottle 15. Accordingly, the cap element 9 should be pressed slightly to place it on the base carrier 2 or on the bottle 15.

Marking of the container 15 takes place by way of the configuration of the base carrier 2 and/or the configuration of the cap element 9 in terms of its shape, structure, color or type of material. A multi-part embodiment of the base carrier 2, in particular, allows a clear increase in the possible combinations, in this connection.

Alternatively, an embodiment is also possible, for example, in which the clamping arms and/or a clamping element is/are clamped in place by the base carrier and/or the container opening. A two-part attachment device having a first component to be clamped into the container opening, for example a sealing element, and a second component for attaching the cap element 9 on the base carrier and/or on the container 15, is also possible.

The base carrier 2 can also be composed of multiple parts, vertically and/or diagonally. Also, additional attachment means can be provided on the base carrier 2 and/or on the cap element 9, for additional marking means, such as small flags or the like.

Figure 4:
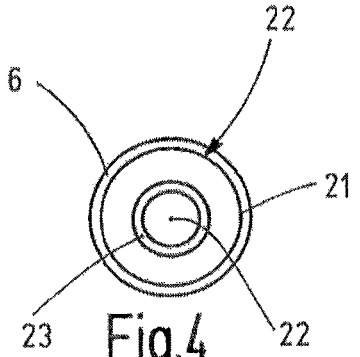
Figure 5:
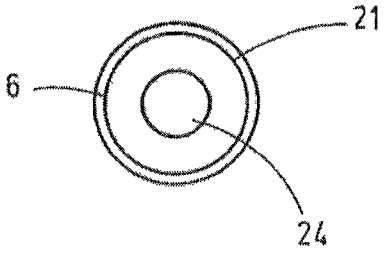

In FIG. 4, a particularly preferred embodiment of the sealing element 6 is shown. The sealing element 6 has a ring-shaped sealing lip 21 that is elevated as compared with the remaining surface of the sealing element 6, for direct contact against the container opening 17, thereby guaranteeing a particularly good seal when the cap element 9, with the sealing element 6 inserted into it, is set onto the container opening 17.

The sealing element 6 furthermore preferably has a recess 22 on the outer rim, which simplifies removal of the sealing element 6 from the cap element 9, for example to replace it. Furthermore, the sealing element 6 has a central passage opening 22 and a ring-shaped region 23 that surrounds the passage opening 22, which region is recessed with regard to the remaining surface of the sealing element 6, in such a manner that attachment of the sealing element 6 on the cap element 9 is possible by means of a clip 24 indicated in FIG. 5. This clip 24 then lies essentially flush with the remaining surface of the sealing element 6 in the installed position, with its head, as shown.

Figure 6:
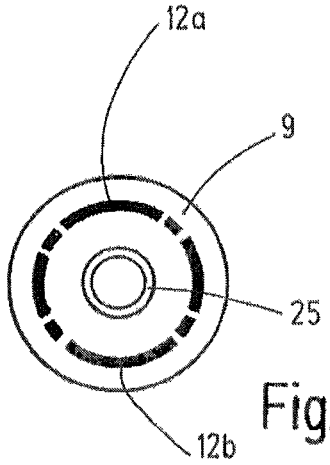

This clip 24 can be releasably inserted into a central tubular accommodation 25 of the cap element, which can be seen in FIG. 6, with shape fit and/or force fit.

Figure 7:
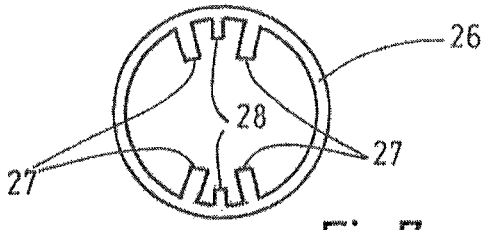
Figure 9:
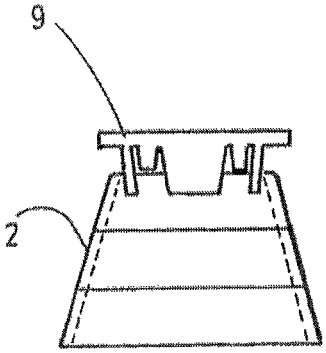

In FIG. 7, a lid ring 26 is shown, which can be releasably connected with the underside of the cap element 9 by means of clamping elements 27, 28, and thereby the clamping arms 11*a*, 11*b*, 13*a*, 13*b* cannot be seen from the outside when the cap element 9 is connected with the base element 1*a*, 1*b*, 1*c* in the manner shown in FIG. 9.

Figure 8:
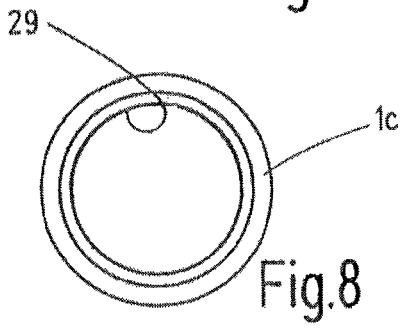

In FIG. 8, another preferred embodiment of at least one base element 1*a*, 1*b*, 1*c* is shown. At least one of the base elements 1*a*, 1*b*, 1*c* has a ring-shaped, circumferential rubber lip 29 on the inside, which lip can be firmly laid against a neck of a bottle, with a clamping effect. This rubber lip preferably consists of a soft rubber material and guarantees that the base elements 1*a*, 1*b*, 1*c* are firmly held on the neck 16 of the bottle. Normally, one such rubber lip 29 is sufficient, but fundamentally, all the base elements 1*a*, 1*b*, 1*c* can be equipped accordingly.

In FIG. 9, a further connection possibility between the base carrier 2 and the cap element 9 is shown. In this connection, the cap element 9 can be radially (releasably) attached to the base carrier 2, by means of the attachment device, in such manner that the base carrier 2 and the cap element 9 together form a handling and carrying device for the container 15 (this is the third position of the marking device). For this purpose, and this is not shown in any detail, projections or set-backs are preferably provided on the clamping arms 11*a*, 11*h*, 13*a*, 13*b*, which allow a releasable connection between the cap element 9 and the base carrier 2 in the position shown in FIG. 9. In this position, the cap element 9 is situated on the bottle opening and the base carrier 2 is displaced upward as compared with the position shown in FIG. 3, i.e. it does not lie against the neck 16 of the bottle, but rather is only connected with the cap element 9. The cap element 9 and the base carrier 2 together then form a handling and carrying device for the container 15.

The invention claimed is:

1. A marking device for tagging a container (15) for beverages, having a base carrier (2) configured to be disposed on the container (15), and a cap element (9) having an attachment device (9*b*), configured as a closure for a container opening (17) of the container (15), wherein the attachment device (9*b*) is configured in such a manner that the cap element (9) can be releasably connected with the container (15) in a first position, and with the base carrier (2) in a second position, with shape fit or force fit, wherein the base carrier (2) is configured in ring shape or in the shape of a ring segment, to be set onto a bottle neck (16) of the container (15), and that the attachment device (9*b*) has at least two clamping arms (11*a*, 11*b*, 13*a*, 13*b*) that are configured in such a manner that they clamp the cap element (9) in place on the container (15) in the first position, by means of being set onto an outer edge (18) of the bottle neck (16) of the container (15), and on the base carrier (2) in the second position, by means of being set onto an upper edge (10) and a lower edge (11) of the base carrier (2).

2. The marking device according to claim 1, wherein the attachment device (9*b*) has at least two pairs of clamping arms (11*a*, 11*b*, 13*a*, 13*b*), which are disposed to lie opposite one another, in each instance, on a common circular path.

3. The marking device according to claim 1, wherein a snap element (12*a*, 12*b*) is configured on the clamping arms (11*a*, 11*b*, 13*a*, 13*b*) for snapping the clamping arms (11*a*, 11*b*, 13*a*, 13*b*) in place on the outer edge (18) of the container (15) and on the upper edge (10) and the lower edge (11) of the base carrier (2).

4. The marking device according to claim 1, wherein the cap element (9) is configured in one piece with the attachment device (9*b*).

5. The marking device according to claim 1, wherein the cap element (9) has a sealing element (6) for sealing a container opening (17).

6. The marking device according to claim 5, wherein the sealing element (6) has a ring-shaped sealing lip (21) for direct contact with the container opening (17).

7. The marking device according to claim 5, wherein the sealing element (6) is releasably connected with the cap element (9) by means of a clip (24).

8. The marking device according to claim 1, wherein the base carrier (2) has a conically configured inside surface (3*a*, 3*b*, 3*c*), at least in certain sections.

9. The marking device according to claim 1, wherein the base carrier (2) is formed from a plurality of base elements (1*a*, 1*b*, 1*c*), wherein a first base element (1*a*, 1*b*, 1*c*) has at least one surface section that is configured to correspond to at least one surface section of a second base element (1*a*, 1*b*, 1*c*).

10. The marking device according to claim 9,
wherein the corresponding surface sections are configured in such a manner that they can be screwed or clamped against one another, snapped into one another or hooked into one another.

11. The marking device according to claim 9,
wherein the corresponding surface sections are configured as a tongue-and-groove connection or as a lap.

12. The marking device according to claim 9,
wherein the first base element (1*a*, 1*b*, 1*c*) can be distinguished from the second base element (1*a*, l*b*, l*c*) in terms of its color, by means of its type of material or by means of its physical shape.

13. The marking device according to claim 9,
wherein at least one base element (1*a*, 1*b*, 1*c*) has a ring-shaped, circumferential rubber lip (29), which can be firmly laid against the bottle neck (16), with a clamping effect.

14. The marking device according to claim 1,
wherein the clamping arms (11*a*, 11*b*, 13*a*, 13*b*) have projections or setbacks that can releasably engage in the base carrier (2) in such a manner that the base carrier (2) and the cap element (9) together form a handling and carrying device for the container (15).

* * * * *